US008292640B1

(12) United States Patent
Wu et al.

(10) Patent No.: US 8,292,640 B1
(45) Date of Patent: Oct. 23, 2012

(54) USB CONNECTOR

(75) Inventors: Kai-Wen Wu, New Taipei (TW); Yi-Zhong Sheu, New Taipei (TW); Tai-Cherng Yu, New Taipei (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/338,276

(22) Filed: Dec. 28, 2011

(30) Foreign Application Priority Data

Jun. 1, 2011 (TW) ..... 100119132 A

(51) Int. Cl.
*H01R 13/44* (2006.01)

(52) U.S. Cl. ..... 439/131; 439/141

(58) Field of Classification Search ..... 439/131, 439/135, 136, 138, 139, 140, 141
See application file for complete search history.

(56) References Cited

U.S. PATENT DOCUMENTS

| | | | | |
|---|---|---|---|---|
| 6,456,500 | B1 * | 9/2002 | Chen | 361/752 |
| 7,462,044 | B1 * | 12/2008 | Regen et al. | 439/131 |
| 7,566,231 | B2 * | 7/2009 | Regen et al. | 439/131 |
| 8,067,923 | B2 * | 11/2011 | Daniel et al. | 320/112 |
| 2008/0160803 | A1 * | 7/2008 | Morganstern et al. | 439/131 |

* cited by examiner

*Primary Examiner* — Tulsidas C Patel
*Assistant Examiner* — Travis Chambers
(74) *Attorney, Agent, or Firm* — Altis Law Group, Inc.

(57) ABSTRACT

A USB connector includes a connector body and a shielding sheet rotatably connected to the connecting body. The connector body includes a connector holder and a plug connected to the connector holder. The plug defines an opening in an end away from the connector holder. The plug is configured for coupling the USB connector to a mating connector. The shielding sheet is rotated to expose the opening of the plug when the USB connector couples to the mating connector, and covers the opening of the plug when the USB connector is detached from the mating connector.

13 Claims, 9 Drawing Sheets

USB CONNECTOR

BACKGROUND

1. Technical Field

The present disclosure relates to a USB connector.

2. Description of Related Art

A USB connector typically includes a connector holder and a plug connected to the connector holder. The plug has an opening in an end thereof away from the connector holder, and the plug is configured for coupling the USB connector with a mating connector. Many USB connectors are not only designed to transmit the electrical signals of an electrical cable, but also designed to transmit the optical signals of an optical fiber cable. Thus, an inner space of the plug of the USB connector should be clean enough to ensure a satisfactory transmitting capability of the USB connector.

A cap may be employed for covering the connecting end of the USB connector when the USB connector is not in use and the cap is removed from the USB connector when the USB connector is in use. However, the cap should be frequently connected to/removed from the USB connector if the USB connector is heavily used, and this is inconvenient. Furthermore, the cap may be easily lost because of the small size thereof.

What is needed therefore is a USB connector addressing the limitations described.

BRIEF DESCRIPTION OF THE DRAWINGS

The components of the drawings are not necessarily drawn to scale, the emphasis instead being placed upon clearly illustrating the principles of the embodiments of the USB connector. Moreover, in the drawings, like reference numerals designate corresponding parts throughout several views.

DETAILED DESCRIPTION

Figure 1:
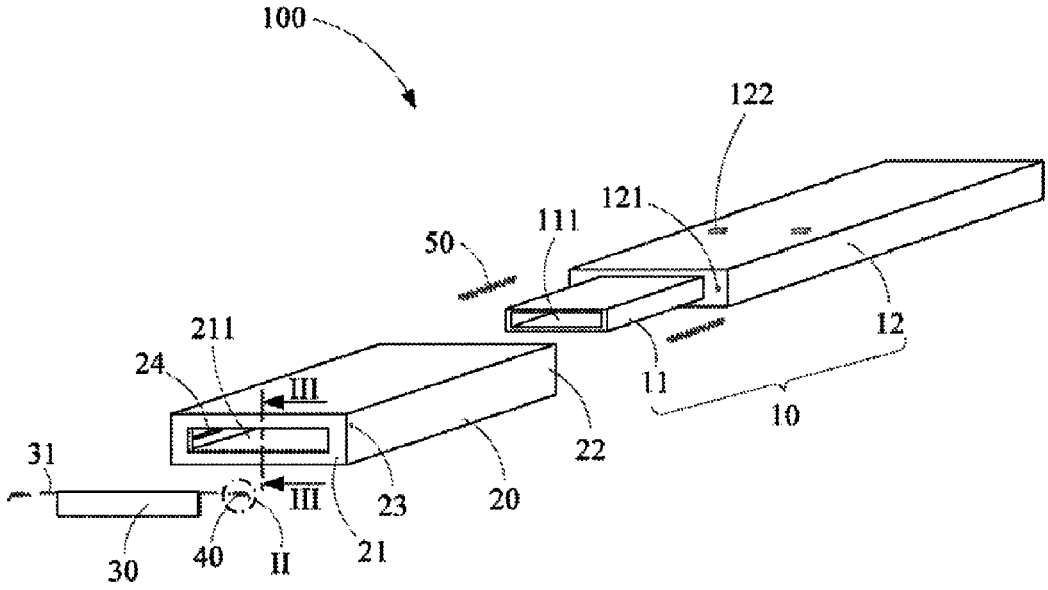
FIG. 1 is an exploded view of a USB connector, according to a first exemplary embodiment of the present disclosure, the USB connector including a housing.
Figure 2:
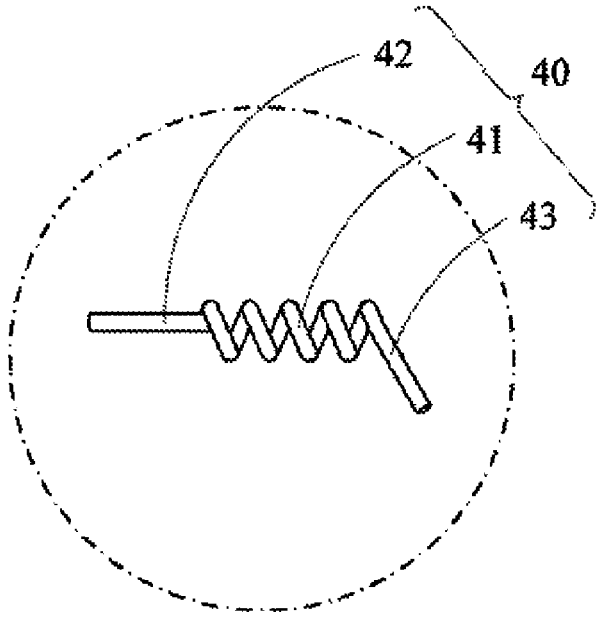
FIG. 2 is an enlarged view of a circled part II of the USB connector of FIG. 1.
Figure 3:
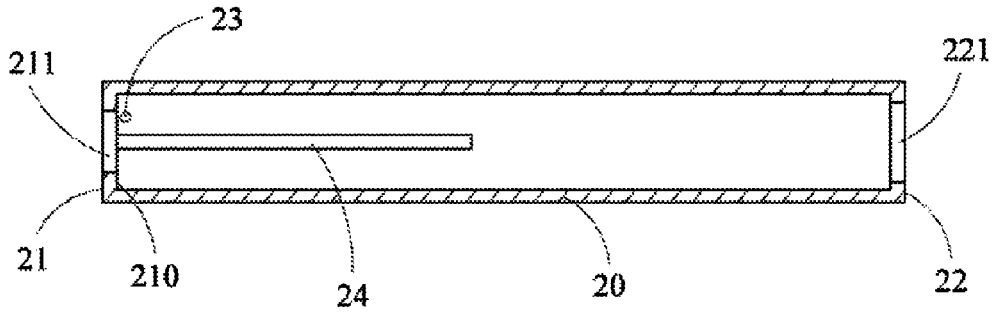
FIG. 3 is a sectional view of the housing of the USB connector of FIG. 1, taken along the line III-III.

Referring to FIGS. 1-3, a USB connector 100, according to a first exemplary embodiment, is shown. The USB connector 100 includes a connector body 10, a housing 20 and a shielding sheet 30.

The connector body 10 includes a plug 11 and a connector holder 12 connected to the plug 11. The plug 11 is configured for coupling the USB connector 100 with a mating connector (not shown). The plug 11 defines an opening 111 in the end away from the connector holder 12, the opening 111 exposes a coupling member (not shown) of the USB connector 100. The connector holder 12 is substantially rectangular. An end surface of the connector holder 12 connected to the plug 11 defines two guiding holes 121 therein, the guiding holes 121 are adjacent to the two sides of the connector holder 12. The central axis of each guiding hole 121 is substantially parallel to the extending direction of the plug 11. The connector holder 12 includes a number of restricting blocks 122 protruding from the side surface(s) thereof. Alternatively, the restricting blocks 122 can be connected to each other, thereby forming a continuous restricting portion all the way round the connector holder 12. The end of the connector holder 12 away from the plug 11 connects to a signal transmitting cable (not shown). The signal transmitting cable can be an optical fiber cable or an electrical cable. In this embodiment, the signal transmitting cable is an optical fiber cable.

The housing 20 is hollow and substantially rectangular. The housing 20 includes a front end 21 and an opposite rear end 22. The housing 20 defines a front opening 211 in the front end 21 and a rear opening 221 in the rear end 22. The shape and size of the front opening 211 corresponds to that of the end surface of the plug 11 away from the connector holder 12, and the shape and size of the rear opening 221 corresponds to that of the end surface of the connector holder 12 connected to the plug 11. In one embodiment, the size of the front opening 211 is slightly larger than that of the end surface of the plug 11 away from the connector holder 12, and the size of the rear opening 221 is slightly larger than that of the end surface of the connector holder 12 which is connected to the plug 11. The housing 20 defines two pivot holes 23. The pivot holes 23 are adjacent to the front opening 211 of the housing 20. In this embodiment, the pivot holes 23 are through holes. The housing 20 includes two guiding bars 24 which protrude from an inner surface 210 of the housing 20 at the front end 21. The guiding bars 24 are substantially coaxial with the guiding holes 121.

The shielding sheet 30 has a shape and size corresponding to that of the front opening 211 for covering the front opening 211. The shielding sheet 30 includes two pivots 31 protruding from opposite sides thereof.

The USB connector 100 further includes two first elastic members 40 and two second elastic members 50. Each first elastic member 40 includes a spiral portion 41, a first elastic leg 42 and a second elastic leg 43. The first elastic leg 42 and the second elastic leg 43 are integrally connected to opposite ends of the spiral portion 41. The first elastic leg 42 extends in a direction substantially parallel to the central axis of the spiral portion 41, and the second elastic leg 43 extends tangentially from the central axis of the spiral portion 41. The second elastic members 50 are spiral springs.

Figure 4:
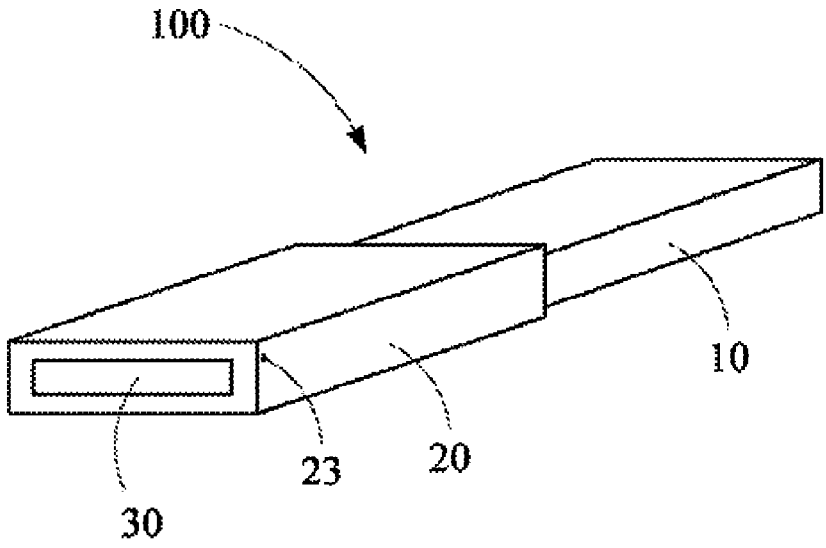
FIG. 4 is a view of the assembled USB connector of FIG. 1.
Figure 5:
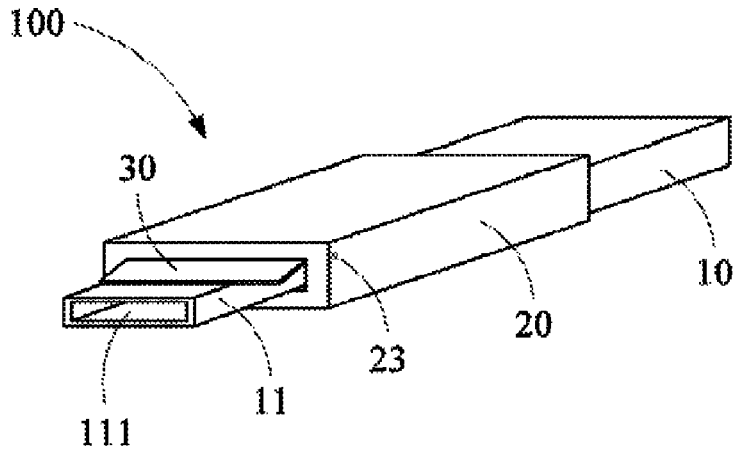
FIG. 5 is an isometric view of the USB connector of FIG. 1, when the USB connector is in use.

Referring also to FIGS. 4-5, in assembly, the shielding sheet 30 is connected to the front end 21 of the housing 20 and covers the front opening 211 of housing 20, with the ability to rotate away from, and back to, the opening 211. In detail, the first elastic members 40 respectively fit over the pivots 31 of the shielding sheet 30, the pivots 31 are inserted into the pivot holes 23, the first elastic leg 42 contacts with the surface of the shielding sheet 30 away from the housing 20, and the second leg 43 connects with the inner surface 210 at the front end 21 of the housing 20. The second elastic members 50 fit over the guiding bars 24, and the guiding bars 24 are inserted into the guiding holes 121. Each second elastic member 50 is sandwiched between the inner surface 210 at the front end 21 of the housing 20 and the end surface of the connector holder 12 connected to the plug 11. The restricting blocks 122 form a backward limit to the movement of the rear end 22. A portion of the connector holder 12 always protrudes out of the housing 20 through the rear opening 221.

In use, a user can take hold the portion of the connector holder 12 protruding from the housing 20 to connect the USB connector 100 to a mating connector (not shown). In detail, the plug 11 is pushed towards the front end 21 of the housing 20, so pushing the shielding sheet 30 away from the front opening 211, and passing through the front opening 211, to enable coupling with a mating connecter. When the connector holder 12 is moved towards the front end 21, the second elastic members 50 are compressed, and when the shielding sheet 30 is rotated out of the front opening 211, the first elastic members 40 are compressed. Therefore, the plug 11 is always biased by spring pressure to retract back into the housing 20 under the force of the second elastic members 50 when the USB connector 100 is detached from the mating connector, and the shielding sheet 30 automatically drops to cover the front opening 211 again under the force of the first elastic members 40. Structured as such, the housing 20 and the shielding sheet 30 keep the plug 11 of the connector body 10 as far as possible free from pollutants such as dust and moisture.

Figure 6:
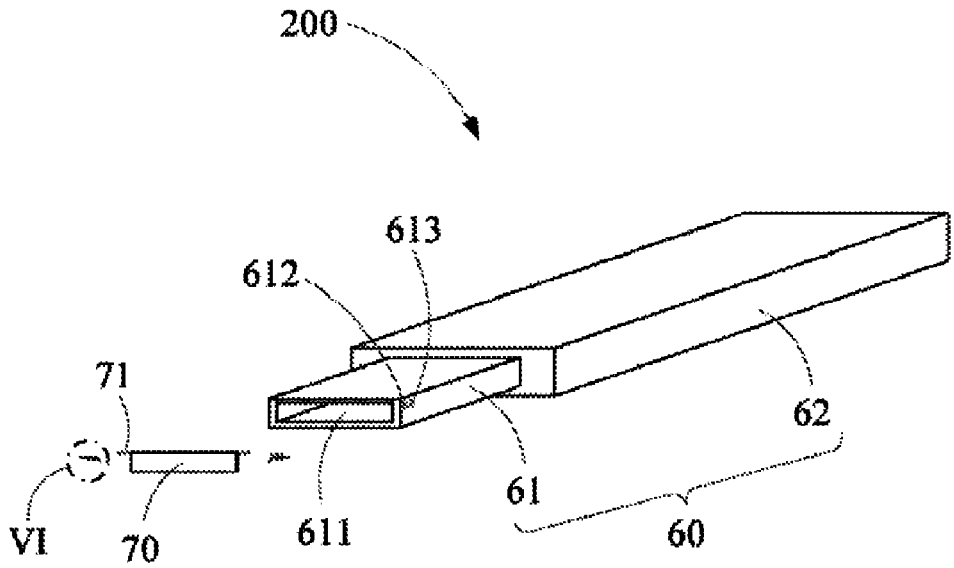
FIG. 6 is an exploded view of a USB connector, according to a second exemplary embodiment of the present disclosure.
Figure 7:
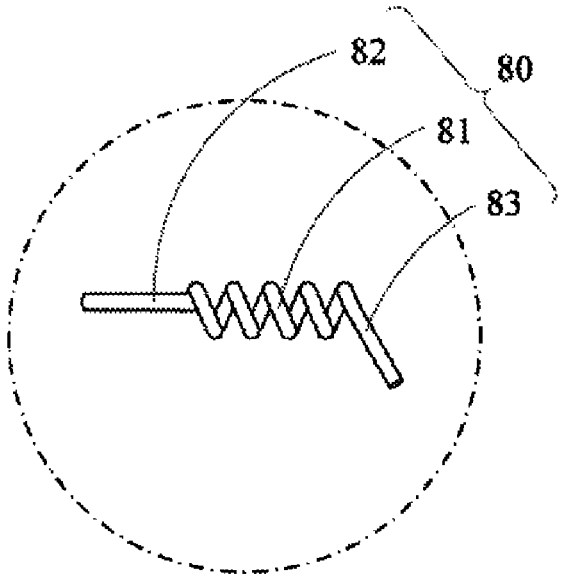
FIG. 7 is an enlarged view of a circled part VI of the USB connector of FIG. 6.

Referring to FIGS. 6-7, a USB connector 200, according to a second exemplary embodiment, is shown. The USB connector 200 includes a connector body 60, a shielding sheet 70 and two first elastic members 80. The connector body 60 includes a plug 61 and a connector holder 62 connected to the plug 61. The plug 60 defines an opening 611 in the end surface thereof away from the connector holder 62. The shielding sheet 70 includes two pivots 71 protruding from two sides thereof. Each first elastic member 80 includes an spiral portion 81, a first elastic leg 82 and a second elastic leg 83. Furthermore, the shielding sheet 70 has a shape and size corresponding to that of the opening 611 of the plug 61. The plug 61 defines two pivot holes 612 and two fixing holes 613 on two sidewalls thereof. Each fixing hole 613 is adjacent to a respective one of the pivot holes 612. In this embodiment, the pivot holes 612 and the fixing holes 613 are all through holes.

Figure 8:
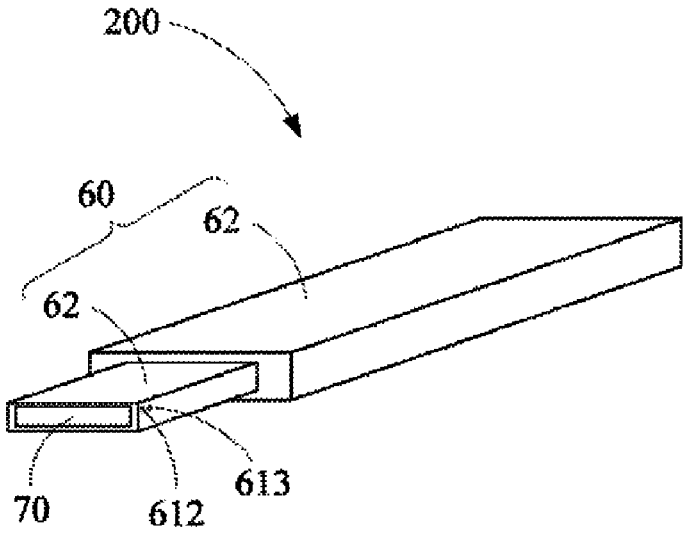
FIG. 8 is a view of the assembled USB connector of FIG. 6.
Figure 9:
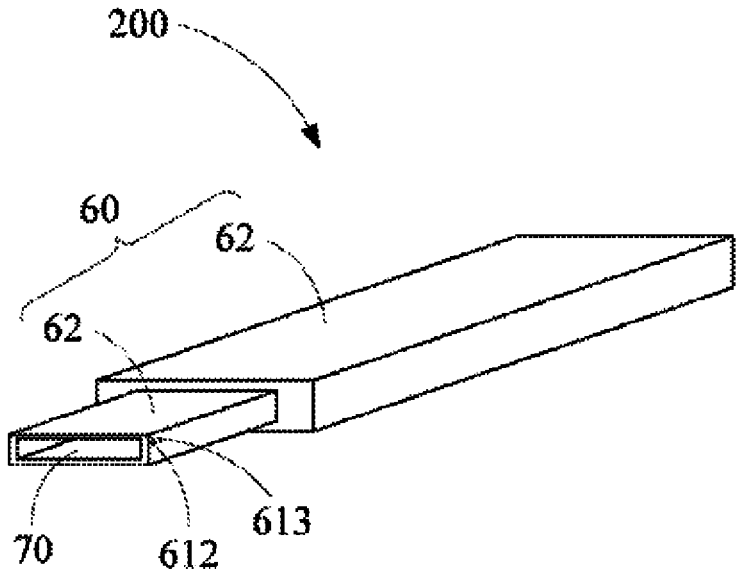
FIG. 9 is an isometric view of the USB connector of FIG. 6, when the USB connector is in use.

Referring also to FIGS. 8-9, in assembly, the shielding sheet 70 is rotatably connected to the distal end of the plug 61 and, at rest, covers the opening 611 of the plug. In detail, the first elastic members 80 fit over the pivots 71, the pivots 71 are inserted into the pivot holes 612, the first elastic legs 82 of the first elastic members 80 are inserted into the fixing holes 613, and the second elastic legs 83 of the first elastic members 80 make contact with a surface of the shielding sheet 70 away from the connector holder 62.

In use, a user can take hold of the connector holder 62 to connect the USB connector 200 to a mating connector (not shown). When the USB connector 200 is connected to the mating connector, the shielding sheet 70 has rotated to the top surface of the plug 61. During the rotation of the shielding sheet 70, the first elastic members 80 are compressed. Therefore, the plug 11 automatically covers the opening of the plug 61 under the force of the second elastic members 50 when the USB connector 100 is detached from the mating connector. Structured as such, the shielding sheet 70 can as far as possible keep the plug 61 free from pollutants such as dust and moisture.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A USB connector, comprising:

a connector body, comprising:

a connector holder; and a plug connected to the connector holder, the plug defining an opening in an end away from the connector holder, the plug being configured for coupling the USB connector with a mating connector;

a housing having a front end and an opposite rear end, the housing defining a front opening in the front end and a rear opening in the rear end, the plug being movably received in the housing, a portion of the connector holder protruding out of the housing through the rear opening; and a shielding sheet rotatably connected to the housing adjacent to the front end and covering the front opening, the shielding sheet being rotated to expose the opening of the plug when the USB connector couples to the mating connector, and covering the opening of the plug when the USB connector is detached form the mating connector.

2. The USB connector of claim 1, wherein the connector holder comprises a number of restricting blocks protruding from side surfaces thereof, the restricting blocks provides a backward limit to the movement of the rear end of the housing.

3. The USB connector of claim 1, wherein the housing defines two pivot holes in opposite inner surfaces thereof, the two pivot holes are close to the front opening, the shielding sheet comprises two pivots protruding from opposite sides thereof, the pivots respectively insert into the pivot holes.

4. The USB connector of claim 3, wherein the pivot holes are through holes.

5. The USB connector of claim 3, wherein the USB connector comprises two first elastic member, the first elastic members respectively fit over the pivots and are restricted between the shield sheet and the housing, the first elastic members are compressed when the shielding sheet is rotated to expose the opening of the plug and configured to provide an elastic force to rotate the shielding sheet back to cover the opening of plug.

6. The USB connector of claim 5, wherein each first elastic member comprises a spiral portion, a first elastic leg and a second elastic leg, the first elastic leg and the second elastic leg are integrally connected to opposite ends of the spiral portion, the first elastic leg contacts with a surface of the shielding sheet facing away from the housing, and the second leg connects with an inner surface of the housing at the front end.

7. The USB connector of claim 6, wherein the first elastic leg extends in a direction substantially parallel to an central axis of the spiral portion, and the second elastic leg extends in a direction tangentially from the central axis of the spiral portion.

8. The USB connector of claim 1, wherein an end surface of the connector holder connected to the plug defines two guiding holes therein, the housing comprises two guiding bars protrude from an inner surface of the housing at the front end, the guiding bars respectively insert into the guiding holes.

9. The USB connector of claim 8, wherein the guiding bars are substantially perpendicular to the inner surface of the housing at the front end, and a central axis of each guiding hole is substantially coaxial with a respective one of the guiding bars.

10. The USB connector of claim 8, wherein the USB connector further comprises two second elastic members, the two second elastic members respectively fit over the guiding bars, and two opposite ends of each second elastic member are respectively resisted on the inner surface of the housing at the front end and the end surface of the connector holder which is connected to the plug.

11. A USB connector, comprising:

a connector body, comprising:

a connector holder; and a plug connected to the connector holder, the plug defining an opening in an end away from the connector holder, the plug being configured for coupling the USB connector with a mating connector; and a shielding sheet rotatably connected to the connector body, the shielding sheet being rotated to expose the opening of the plug when the USB connector couples to the mating connector, and covering the opening of the plug when the USB connector is detached form the mating connector;

wherein the shielding sheet comprises two pivots protruding from two opposite sides thereof, the plug defines two pivot holes in two opposite inner surfaces thereof adjacent to the opening, the pivots respectively insert into the pivot holes.

12. The USB connector of claim 11, wherein the USB connector comprises two first elastic members, the first elastic members respectively fit over the pivots and are restricted between the shielding sheet and the plug, the first elastic members are compressed when the shielding sheet is rotated to expose the opening of the plug and configured to provide an elastic force to rotate the shielding sheet back to cover the opening of plug.

13. The USB connector of claim 12, wherein each first elastic member comprises a spiral portion, a first elastic leg and a second elastic leg, the first elastic leg and the second elastic leg are integrally connected to opposite ends of the spiral portion, the plug defines two fixing holes each nearby a corresponding pivot hole, the first elastic legs of the first elastic members respectively insert into the fixing holes, and the second elastic legs of the first elastic members contact with a surface of the shielding sheet facing away from the connector holder.

* * * * *